US011346528B2

(12) United States Patent
Dahlen et al.

(10) Patent No.: US 11,346,528 B2
(45) Date of Patent: May 31, 2022

(54) LIGHTING FIXTURE HAVING UNIFORM BRIGHTNESS

(71) Applicant: KENALL MANUFACTURING COMPANY, Kenosha, WI (US)

(72) Inventors: Kevin Dahlen, Lindenhurst, IL (US); Steven Akiyama, New Lenox, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 0 days.

(21) Appl. No.: 16/543,145

(22) Filed: Aug. 16, 2019

(65) Prior Publication Data

US 2021/0048169 A1 Feb. 18, 2021

(51) Int. Cl.

| | |
|---|---|
| ***F21S 8/02*** | (2006.01) |
| ***F21V 13/04*** | (2006.01) |
| ***F21V 23/00*** | (2015.01) |
| ***F21V 5/00*** | (2018.01) |
| ***F21V 7/00*** | (2006.01) |
| ***F21V 21/04*** | (2006.01) |
| *F21Y 115/10* | (2016.01) |

(52) U.S. Cl.

CPC ..... *F21V 13/04* (2013.01); *F21S 8/026* (2013.01); *F21V 5/00* (2013.01); *F21V 7/0033* (2013.01); *F21V 21/04* (2013.01); *F21V 23/008* (2013.01); *F21Y 2115/10* (2016.08)

(58) Field of Classification Search

CPC ..... F21S 8/026; F21S 8/04

See application file for complete search history.

(56) References Cited

U.S. PATENT DOCUMENTS

| | | | | |
|---|---|---|---|---|
| 6,024,465 | A * | 2/2000 | Kobayashi | F21S 8/026 362/264 |
| 6,435,693 | B1 * | 8/2002 | Fiene | F21V 23/02 362/147 |
| 6,439,736 | B1 * | 8/2002 | Fiene | F21V 7/24 362/147 |
| 7,654,702 | B1 * | 2/2010 | Ding | F21V 29/004 362/294 |
| 7,726,848 | B2 * | 6/2010 | Lai | F21V 31/04 362/298 |
| 9,279,564 | B1 * | 3/2016 | Householder | F21V 7/08 |
| 9,945,533 | B1 * | 4/2018 | Orbe | F21V 3/00 |
| 10,935,191 | B2 * | 3/2021 | Zhang | F21V 21/048 |
| 2008/0225512 | A1 * | 9/2008 | Roberts | G02F 1/133605 362/97.1 |
| 2012/0140461 | A1 * | 6/2012 | Pickard | F21V 7/0091 362/225 |
| 2014/0071665 | A1 * | 3/2014 | Huang | F21V 21/04 362/218 |

(Continued)

*Primary Examiner* — Zheng Song

(74) *Attorney, Agent, or Firm* — Marshall, Gerstein & Borun LLP; Randall G. Rueth

(57) ABSTRACT

A lighting fixture includes a housing, a light source, and a lens. The housing includes a base and first and second sidewalls. Each of the sidewalls extend obtusely from the base. The light source is operably coupled to the base and includes a plurality of light emitting diodes (LEDs). The lens is operably coupled to at least one of the sidewalls and cooperates with the sidewalls to define an interior cavity. The plurality of LEDs are arranged such that light emitted therefrom is directed from the base toward at least one of the first or second sidewalls and is redirected to the interior cavity a first time.

20 Claims, 5 Drawing Sheets

(56) References Cited

U.S. PATENT DOCUMENTS

| | | | | |
|---|---|---|---|---|
| 2014/0254167 | A1* | 9/2014 | Kennedy | F21V 7/00 362/296.05 |
| 2014/0268764 | A1* | 9/2014 | Stolte | F21V 13/04 362/245 |
| 2014/0328049 | A1* | 11/2014 | Hikmet | F21K 9/62 362/84 |
| 2015/0003055 | A1* | 1/2015 | Lacroix | F21V 7/0033 362/231 |
| 2015/0098215 | A1* | 4/2015 | Torabifard | F21V 7/0008 362/217.07 |
| 2015/0338084 | A1* | 11/2015 | Ryder | F21V 21/30 362/365 |
| 2018/0172227 | A1* | 6/2018 | Soler | F21V 7/0033 |
| 2019/0086058 | A1* | 3/2019 | Lim | F21V 7/0091 |
| 2021/0080640 | A1* | 3/2021 | Yeo | G02B 6/0055 |

* cited by examiner

LIGHTING FIXTURE HAVING UNIFORM BRIGHTNESS

FIELD OF THE DISCLOSURE

The present disclosure generally relates to lighting fixtures and, more particularly, to lighting fixtures capable of producing uniform and/or near-uniform brightness.

BACKGROUND

Certain healthcare environments such as clean rooms, laboratories, and/or other similar facilities require sterile or near-sterile conditions in order to properly perform desired functions. For example, experimentation or scientific research, manufacturing of electronic components, pharmaceutical devices, and the like may all require and/or benefit from sterile environments. These clean rooms are typically a controlled environment having a low pollutant levels (such as, for example, dust particles, airborne microbes, aerosol particles, and/or vapors). Due to the demanding nature of work performed in these environments, consistent, high-quality lighting sources are needed that are capable of generating uniform illumination. More specifically, conventional lighting philosophy dictates that light sources direct light directly to and through the lens so as to maximize efficiency of the lighting fixture. Such light sources must also adhere to clean room specifications, and as such, must be capable of maintaining a clean room seal during the completion of necessary maintenance in these environments to minimize a risk of environmental contamination.

SUMMARY

Embodiments within the scope of the present invention are directed to a lighting fixture that includes a housing, a light source, and a lens. The housing includes a base and first and second sidewalls. Each of the sidewalls extend obtusely from the base. The light source is operably coupled to the base and includes a plurality of light emitting diodes (LEDs). The lens is operably coupled to at least one of the sidewalls and cooperates with the sidewalls to define an interior cavity. The plurality of LEDs are arranged such that light emitted therefrom is directed from the base toward at least one of the first or second sidewalls and is redirected to the interior cavity a first time. In some examples, a cross-section taken through the base and the first and second sidewalls has a trapezoidal shape.

In some examples, upon being redirected to the interior cavity, the lens is arranged to redirect a majority of the emitted light back to the interior cavity a second time. In some approaches, the lens may have a transmissivity of approximately 85%. Other transmissivity values are possible.

In some examples, each of the plurality of LEDs includes a primary optic configured to direct the light in a batwing light distribution pattern. Further, in some of these examples, the plurality of LEDs may be arranged in a linear array, and can be accommodated in the interior cavity. The interior cavity may be sealably formed by the housing and the lens.

In some approaches, at least one of the first sidewall or the second sidewall includes a reflective coating disposed on an interior surface thereof. In these examples, the reflective coating may have a reflectance value of approximately 95%. Other reflectance values are possible.

In some examples, at least one of the first or the second sidewall forms at least one of a linear, a parabolic, an involute, or a hyperbolic cross-sectional shape. Further, in some approaches, the lighting fixture may include a driver box operably coupled to the housing that drives the plurality of LEDs.

In accordance with a second aspect, an approach for distributing light includes emitting light from a light source that is at least partially disposed within a cavity towards a first or a second sidewall in a manner that the emitted light is directly incident upon the sidewall. The emitted light is directed, via the first or the second sidewall, from the light source a first time towards a lens. The emitted light is then directed, via the lens, a second time towards the first or the second sidewall. The emitted light is transmitted through the lens to an environment external to the cavity.

BRIEF DESCRIPTION OF THE DRAWINGS

The above needs are at least partially met through provision of the lighting fixture having uniform brightness described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated and/or simplified relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a lighting fixture is provided for use in varying environments. The lighting fixture advantageously provides for more uniform brightness as compared to conventional approaches while also being useable in sterile or near-sterile environments. More specifically, instead of adhering to conventional approaches where fixtures are arranged such that emitted light is immediately directed to the lens, the lighting fixtures described herein instead first direct light towards the sidewalls to generate reflections within the fixture that create more uniform light.

Figure 1:
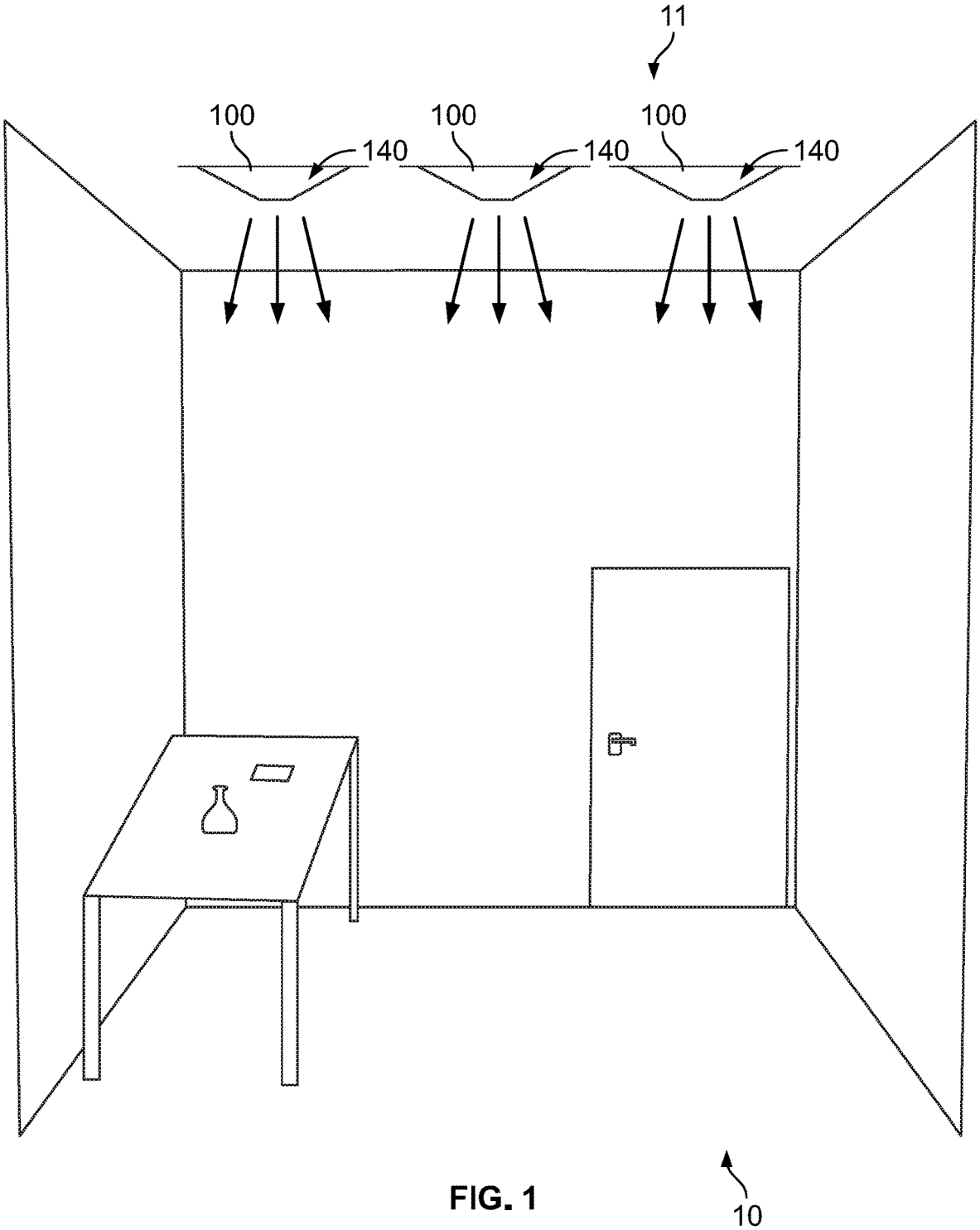
FIG. 1 illustrates a schematic view of an environment including a plurality of lighting fixtures that provide uniform brightness in accordance with various embodiments.
Figure 2:
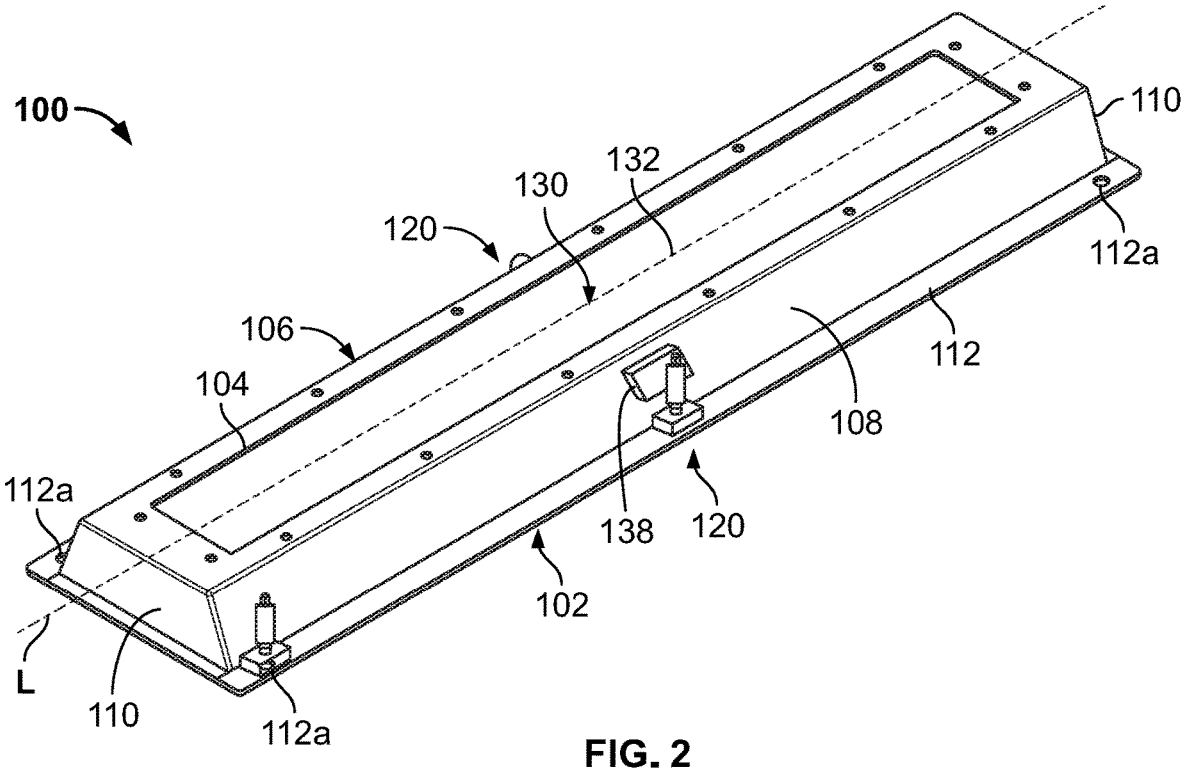
FIG. 2 illustrates a perspective view of an example lighting fixture in accordance with various embodiments.
Figure 3:
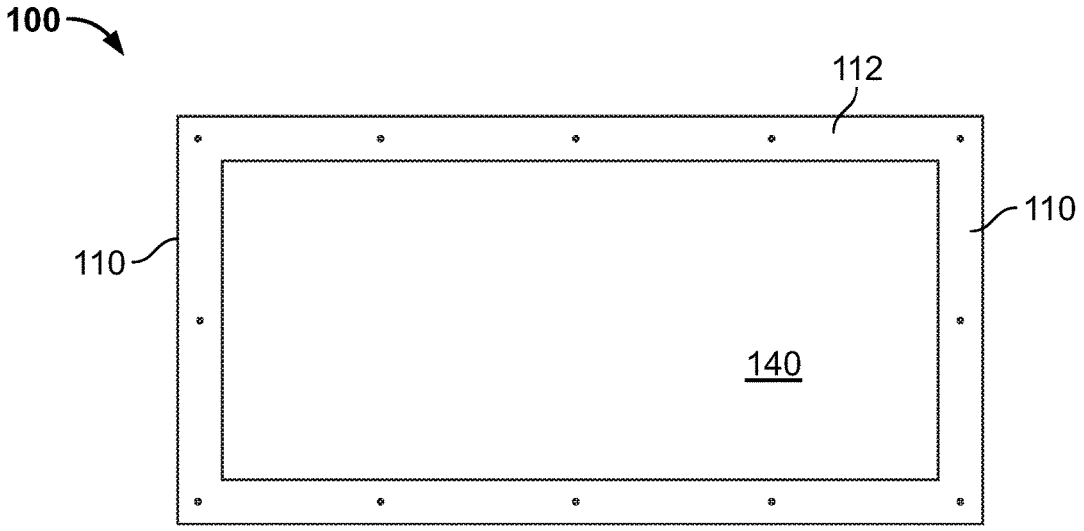
FIG. 3 illustrates a bottom elevation view of the example lighting fixture of FIGS. 1 and 2 in accordance with various embodiments.
Figure 4:
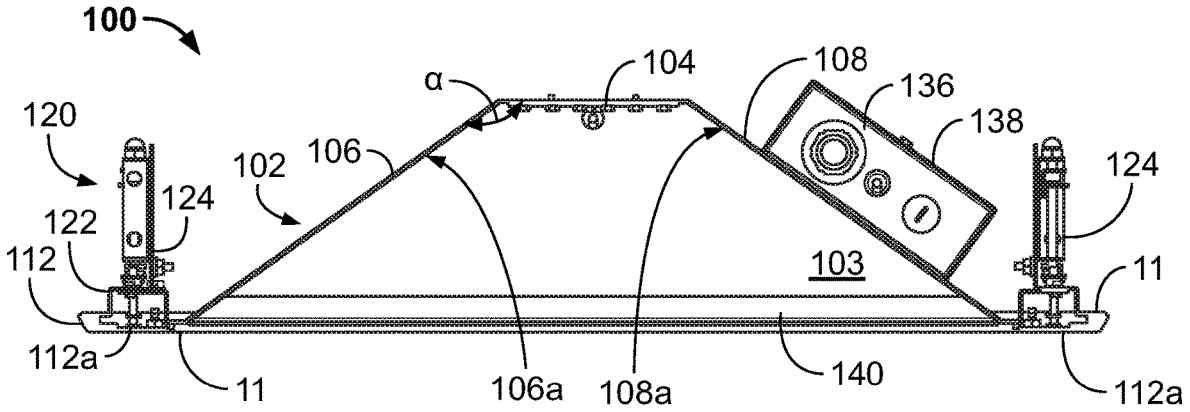
FIG. 4 illustrates a cross-sectional view of the example lighting fixture of FIGS. 1-3 in accordance with various embodiments.

Turning to the figures, FIG. 1 illustrates an environment 10 that can include any number of lighting fixtures 100. The environment 10 can be any room or area that promotes and/or requires a sterile or near-sterile environment, for example, a clean room, a hospital, a doctor's office, an examination room, an operating room, a manufacturing room, a laboratory, a nursing home, a health club, or any other space or building, or portions thereof, where it is desirable to both provide illumination and to maintain and/or promote sterility.

Turning to FIGS. 2-10, details of the lighting fixture 100 illustrated in FIG. 1 will now be described. The lighting fixture 100 is adapted to be mounted to a ceiling, a wall, or any other surface of a clean room or similar environment 10. The lighting fixture 100 illustrated in FIGS. 2-10 generally includes a housing 102, a mounting assembly 120, a light source 130, and a lens 140. The housing 102 may be constructed from any number of suitable materials such as metals (e.g., 14 gauge steel) or similar materials. The housing 102 includes a top wall 104, a first sidewall 106, and a second sidewall 108 that cooperate to define an interior cavity 103. Further, the housing includes end caps 110 operably coupled to the top wall 104 and/or the sidewalls 106, 108 to provide an enclosed arrangement. In some examples, the housing 102 may be in the form of a unitary shell member, and in other examples, the various components of the housing (e.g., the top wall 104, the first and second sidewalls 106, 108, and/or the end caps 110) may be operably coupled to each other using any number of suitable approaches such as fasteners, welds, and the like.

The first sidewall 106 and the second sidewall 108 extend away from the top wall 104 in an obtuse configuration. Put differently, as illustrated in FIGS. 2-10, the housing 102 is in the form of a trapezoidal prism or trough wherein an interior angle $\alpha$ formed between the top wall 104 and the first and/or second sidewalls 106, 108 is greater than approximately 90° but less than approximately 180°. In the illustrated examples, the first and second sidewalls 106, 108 are generally flat, linear, and planar in configuration, but in other examples (not illustrated) the first and/or the second sidewalls 106, 108 may have a parabolic, involute, and/or hyperbolic cross-sectional shape. The housing 102 extends along a longitudinal axis "L", and can have varying lengths such as, for example, 12", 24", 36", 48", etc. Similarly, he housing 102 can have any number of suitable widths (i.e., distances between the first and the second sidewalls 106, 108) such as, for example, 4", 8", 12", 24", etc.

A flange 112 extends outwardly from the first and the second sidewalls 106, 108 and, optionally, also extends from the end caps 110. In the illustrated example, the flange 112 extends generally parallel to the top wall 104. The flange 112 accommodates the mounting assembly 120, and includes mounting structures 112*a* in the form of holes or through-bores used to mount the lighting fixture 100. More specifically, the mounting assembly 120 includes a bracket 122 that secures to the flange 112 and a securement mechanism 124 used to secure the lighting assembly 100. In some examples, a ceiling panel 11 in the environment 10 includes an opening that receives the housing 102. The flange 112 may be disposed below the ceiling panel 11, and as such is partially disposed within the interior of the environment 10. The securement mechanism 124 includes a fastener such as a bolt used to operably secure the lighting fixture 100 to the ceiling panel 11.

An interior surface 106*a* of the first sidewall 106 and an interior surface 108*a* of the second sidewall 108 are coated with a reflective material. For example, a white reflective powder coating such as LGW may be used that has a reflectivity value of approximately 95% to diffuse emitted light in a manner discussed below.

As noted, the lighting fixture 100 includes a light source 130 in the form of an array 132 of light-emitting elements 134. The array 132 is generally arranged in a linear arrangement and is disposed within the interior cavity 103 of the housing 102 and is coupled to the top wall 104. The light-emitting elements 134 can be secured in any known manner (e.g., using fasteners, adhesives, etc.). Any number of light-emitting elements 134 can be utilized, depending on the given application (e.g., depending upon the healthcare environment 100. In some examples, between approximately 300 and 500 light-emitting elements 134 may be used, and more specifically, between approximately 350 and 400 light-emitting elements 134 may be used.

The light-emitting elements 134 in this version take the form of light-emitting diodes (LEDs) and are configured to together (i.e., combine to) emit between approximately 15,000 mW and approximately 150,000 mW of specially configured visible light, i.e., light having a wavelength in a range of between approximately 380 nm and approximately 780 nm. In some cases, the light-emitting elements 134 can be configured to at least 150,000 mW of specially configured visible light.

In any event, the light-emitting elements 134 are configured such that the total or combined light emitted by the array 132 is white, a shade of white, or a different color that is aesthetically non-objectionable in the environment 10. Generally, the total or combined light will have a color rendering index of above 70, and, more preferably, above 80 or above 90, and will have a color temperature in a range of between 1500 degrees and 7000 degrees Kelvin, preferably in a range of between 2100 degrees and 6000 degrees Kelvin, and, more preferably, in a range of between 2700 degrees and 5000 degrees Kelvin.

In some examples, e.g., when LEDs are employed in the lighting device, the lighting fixture 100 can include a means for maintaining a junction temperature of the LEDs below a maximum operating temperature of the LEDs. The means for maintaining a junction temperature may, for example, include one or more heat sinks, spreading heat to printed circuit boards coupled to the LEDs, a constant-current driver topology, a thermal feedback system to one or more drivers (that power the LEDs) via NTC thermistor, or other means that reduce LED drive current at sensed elevated temperatures. The lighting fixture 100 can further include any number of sensors (not shown) such as an occupancy sensor, a daylight sensor, one or more communication modules, and/or one or more control components, e.g., a local controller.

The lighting fixture 100 in this example also includes a driver 136 generally configured to electrically power the light source 130. In this example, the driver 136 takes the form of an LED driver configured to electrically power the light source 130, particularly the LEDs 134. In other examples, e.g., when the lighting fixture 100 includes different light sources, the driver 136 can be a different type of driver. The driver 136 in this example is fixedly coupled to the second sidewall bracket 1 via any number of suitable approaches such as mounting brackets and mounting bolts.

The lighting fixture 100 in this example further includes a driver cover 138 arranged to cover and protect the driver 136. The driver cover 138 can be so mounted via any known means (e.g., via fasteners, via adhesive, and/or by sandwiching the cover 138 between various components).

The lens 140 is operably coupled to the first and/or second sidewalls 106, 108, the end caps 110, and/or the flange 112, and further defines the interior cavity 103 as a sealed arrangement, which may be desirable for clean room environments. In some examples, the lens is a low transmission, high occlusion lens such as model WD 853 Acrylite Satinice or WD 855 Acrylite Satinice. Such a lens 140 may have a light transmission between approximately 70% and approximately 87%, and more preferably between approximately 72% and approximately 85%, and in other words has a reduced transmission when compared to conventional lenses used in these environments 10. In some examples, the lens 140 is between approximately 0.05" and approximately 0.2" thick, and preferably approximately 0.118" thick. The lens 140 may be colorless and/or have a frosted surface. The lens 140 may also be co-extruded from 100% recyclable acrylic and can additionally be UV-resistant.

The lighting fixture 100 is, in some cases, fully enclosed, which promotes cleanliness, by, for example, preventing pathogens from nesting on or within internal components of the lighting fixture 100, which would otherwise be hard to reach, and also prevents pathogens from exiting the interior cavity 103 and entering into the clean room environment 10.

Finally, it will be appreciated that the lighting fixture 100 includes additional components disposed in the housing 102. First, the lighting fixture 100 includes wiring that connects the electronic components to one another. The lighting fixture 100 may also, for example, include a local controller that communicates data (e.g., operational instructions, motion data) with a central controller or other lighting fixtures 100 in the environment 10, one or more communication modules (e.g., one or more antennae, one or more receivers, and/or one or more transmitters) to effectuate wired or wireless communication between the lighting fixtures 100 and a central controller or other lighting fixtures 100. Such components may be arranged or disposed within or proximate to the enclosed housing 102.

Figure 5:
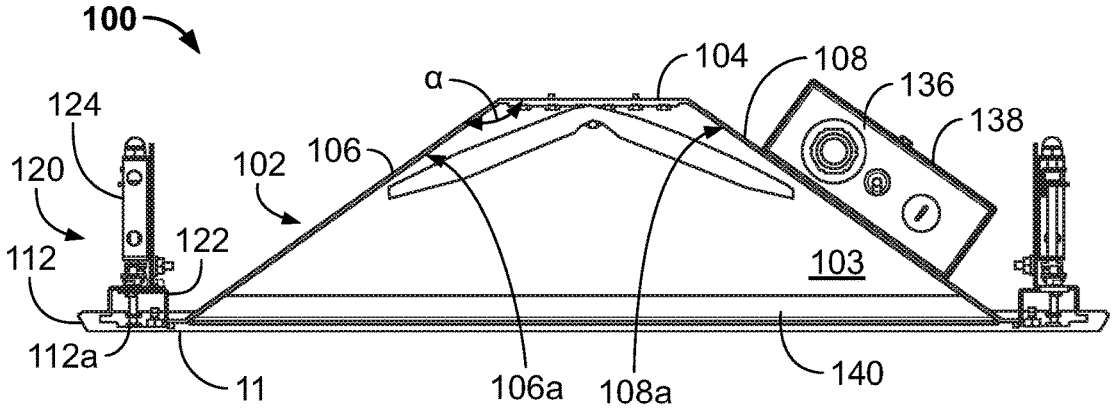
FIG. 5 illustrates a cross-sectional view of the example lighting fixture of FIGS. 1-4 that further illustrates a batwing light distribution in accordance with various embodiments.

Generally speaking, the emitted light is directed from the LEDs 134 in a controlled manner with the purpose of reducing light at nadir and directing it towards the first and second sidewalls 106, 108. In some examples, this may be achieved via a batwing, a collimator, or a similar type of optical arrangement. With reference to FIG. 5, the LEDs 134 include a primary optic that is configured to direct the light in a batwing light distribution from the base 104 to which they are coupled toward the first and/or the second sidewalls 106, 108 at a high enough point on the sidewalls 106 108 that the emitted light is reflected back to the interior cavity 103 toward the lens 140. It is appreciated that the LEDs 134 can include any arrangement of desired optics such as those described in U.S. application Ser. No. 14/215,853 entitled "Downwardly Directing Spatial Lighting System," filed on Mar. 17, 2014, and U.S. application Ser. No. 15/178,461 entitled "Occupancy Driven Lighting Device for Deactivating Dangerous Pathogens", filed on Jun. 9, 2016, the entire contents of each hereby being incorporated by reference. Other light distribution patterns and/or arrangements may be used as desired.

Figure 6:
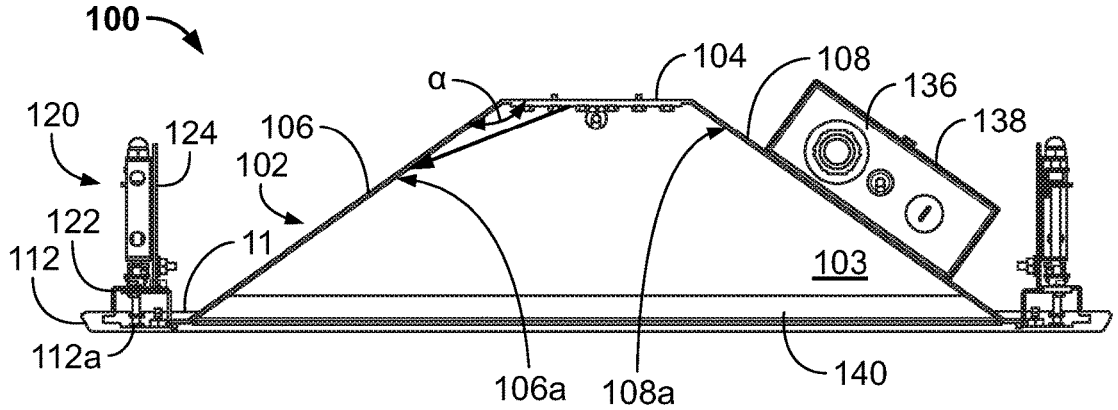
FIG. 6 illustrates a cross-sectional view of the example lighting fixture of FIGS. 1-5 upon illumination of a light source in accordance with various embodiments.
Figure 7:
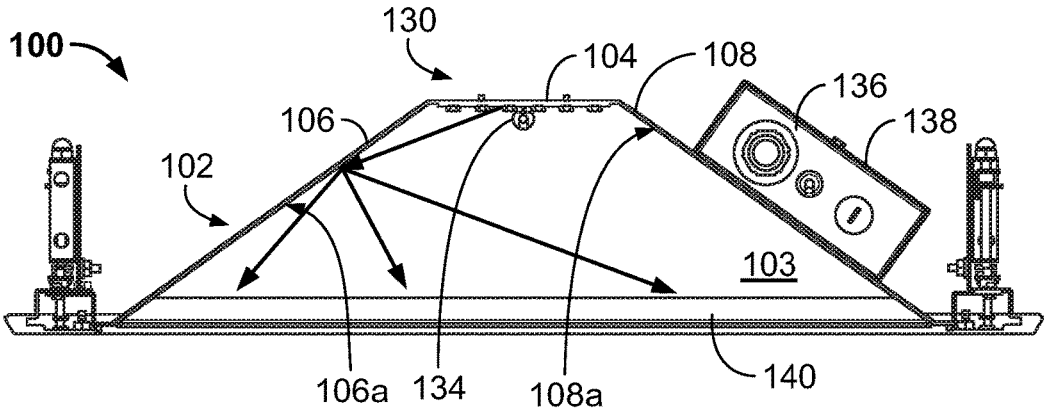
FIG. 7 illustrates a cross-sectional view of the example lighting fixture of FIGS. 1-6 as light progresses through the interior cavity of the lighting fixture in accordance with various embodiments.
Figure 8:
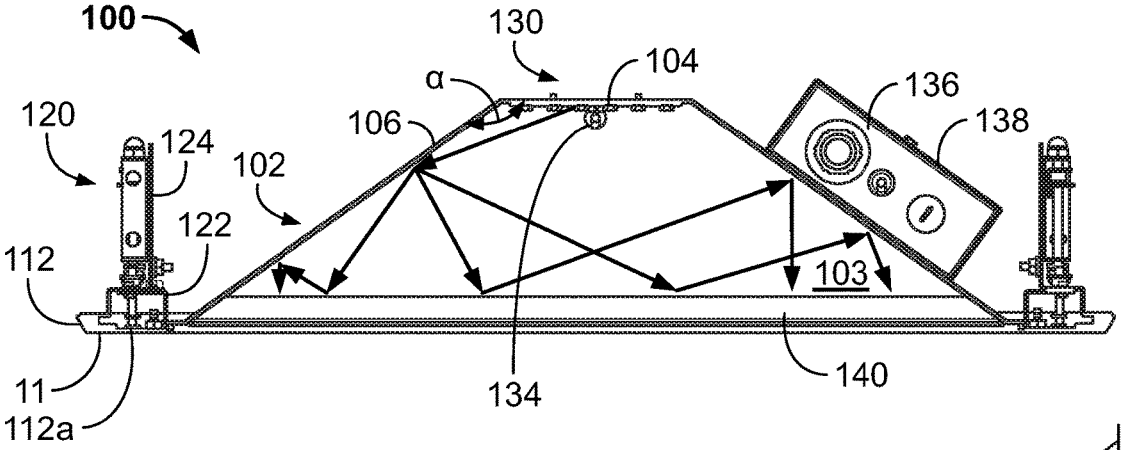
FIG. 8 illustrates a cross-sectional view of the example lighting fixture of FIGS. 1-7 as light continues to progress through the interior cavity of the lighting fixture in accordance with various embodiments.
Figure 9:
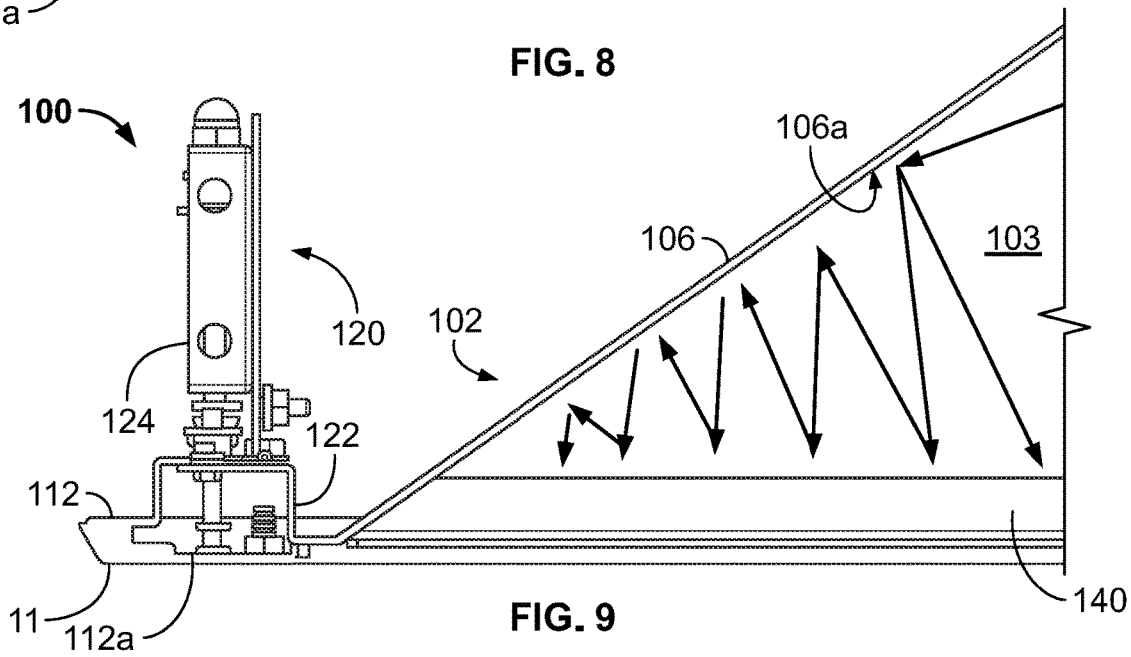
FIG. 9 illustrates a close-up cross-sectional view of the example lighting fixture of FIGS. 1-8 as light reflects within the interior cavity of the lighting fixture in accordance with various embodiments.
Figure 10:
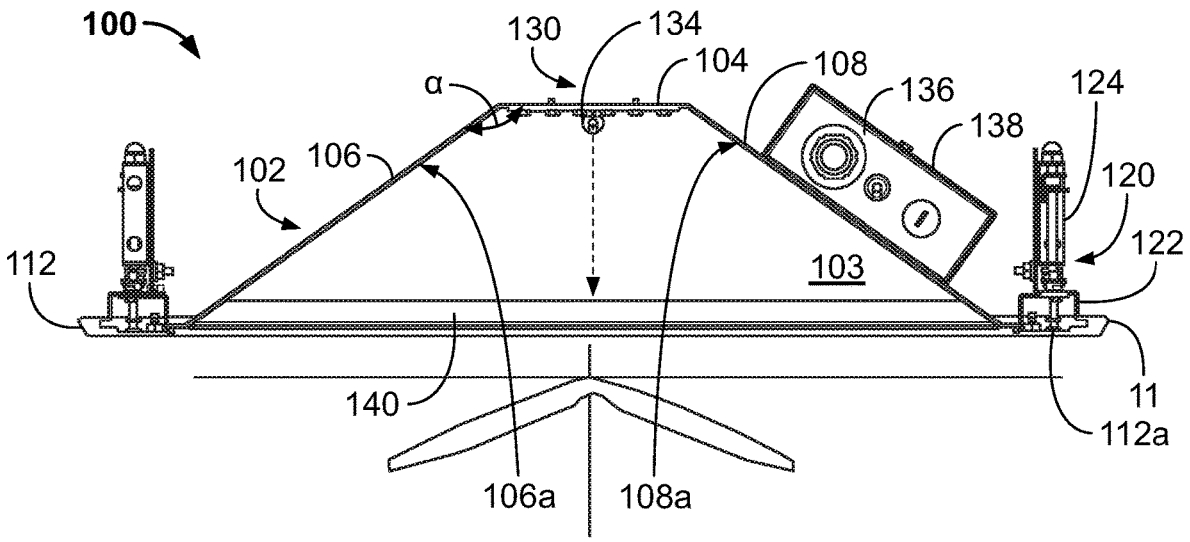
FIG. 10 illustrates a cross-sectional view of the example lighting fixture of FIGS. 1-9 that illustrates an example candela distribution of the output of the lighting fixture in accordance with various embodiments.

With reference to FIGS. 6 and 7, as light is emitted from the LEDs, the reflective interior surfaces 106*a*, 108*a* of the first and the second sidewalls 106, 108 reflect or redirect the light into the interior cavity 103 and towards the lens 140. As illustrated in FIGS. 8 and 9, due to the low transmissivity and high occlusion of the lens 140, the emitted light then reflects or redirects off of the lens 140 and back toward the interior cavity 103. The emitted light may continue reflecting or redirecting off of the sidewalls 106, 108 and the lens 140 any number of times until ultimately exiting the interior cavity 103 via the lens 140. As illustrated in FIG. 10, which represents a candela distribution of the output, there is minimal luminous flux at nadir, and as such, the emitted light is uniform across the area of the lend 140.

While not illustrated, in some examples, a portion of the light may, in some examples, be directly incident on the lens 140. Further, some light may reflect off of sidewall and be immediately transmitted through the lend 140 without reflecting back into the interior cavity 103.

So configured, the candela distribution of the output from the optics results in minimal luminous flux at nadir. By contradicting conventional wisdom of using lenses that minimize light occlusion, the lighting fixture 100 instead relies on occlusion to promote uniformity. Further, as compared to edge-lit arrangements, the lighting fixture 100 described herein allows for a cleanroom seal to be maintained during maintenance. Further, the lighting fixture 100 described herein allows for increased output compared to edge-lit designs because edge-lit arrangements are limited in mounting configuration of the LEDs. The lighting fixture 100 described herein also reduces glare at specific angles where an occupant may be exposed to direct LED viewing. Further, when compared to conventional lighting arrangements, the present lighting fixture 100 requires less input power while producing greater luminous efficacy, while also having increased product lifetimes.

Unless specified otherwise, any of the feature or characteristics of any one of the embodiments of the lighting fixture disclosed herein may be combined with the features or characteristics of any other embodiments of the lighting fixture. Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. A lighting fixture comprising:

a housing having a base, a first sidewall, a second sidewall, and a flange extending from at least one of the first sidewall or the second sidewall, each of the first and second sidewalls extending obtusely from the base, wherein the housing is a unitary shell member, and wherein the flange is generally parallel to the base;

a light source operably coupled to the base of the housing, the light source comprising a plurality of light-emitting diodes (LEDs); and a lens operably coupled to at least one of the first sidewall or the second sidewall, wherein the housing and the lens cooperate to define an interior cavity;

wherein the plurality of LEDs are arranged such that light emitted therefrom is directed from the base toward at least one of the first or second sidewalls and is redirected to the interior cavity a first time, wherein the housing and the lens form a fully enclosed, sealed arrangement that defines the interior cavity to accommodate the plurality of LEDs, wherein the lens is sealably secured to a first surface of the flange, and wherein a second surface of the flange is configured to be secured against an exposed surface of a ceiling or wall when the light fixture is mounted to the ceiling or wall.

2. The lighting fixture of claim 1, wherein upon being redirected to the interior cavity, the lens is arranged to redirect a majority of the emitted light back to the interior cavity a second time.

3. The lighting fixture of claim 2, wherein the lens has a transmissivity of approximately 85.

4. The light fixture of claim 1, wherein a cross-section taken through the base and the first and second sidewalls has a trapezoidal shape.

5. The lighting fixture of claim 1, wherein at least one of the first sidewall or the second sidewall includes a reflective coating disposed on an interior surface thereof.

6. The lighting fixture of claim 1, wherein each of the plurality of LEDs comprises a primary optic configured to direct the light in a batwing light distribution.

7. The lighting fixture of claim 4, wherein the reflective coating has a reflectance value of approximately 95.

8. The lighting fixture of claim 1, wherein at least one of the first sidewall or the second sidewall forms at least one of a linear, a parabolic, an involute, or a hyperbolic cross-sectional shape.

9. The lighting fixture of claim 1, wherein the plurality of LEDs are arranged in a linear array.

10. The lighting fixture of claim 1, further comprising a driver box operably coupled to the housing, the driver box configured to drive the plurality of LEDs.

11. A method of distributing light, the method comprising:

emitting light from a light source at least partially disposed within a cavity, wherein the cavity is defined by a lens and a housing, the housing having a base, a first sidewall, a second sidewall, and a flange extending from at least one of the first sidewall or the second sidewall, wherein the housing is a unitary shell member, wherein the flange is generally parallel to the base, wherein the lens is sealably secured to a first surface of the flange, and wherein a second surface of the flange is configured to be secured against an exposed surface of a ceiling or wall when the light fixture is mounted to the ceiling or wall;

directing the emitted light from the light source to reduce light at nadir of the light source, and to direct the emitted light towards the first sidewall or the second sidewall such that the emitted light is directly incident upon the sidewall;

directing, via the first sidewall or the second sidewall, the emitted light from the light source a first time towards the lens;

directing, via the lens, the emitted light a second time towards the first sidewall or the second sidewall; and transmitting the emitted light through the lens to an environment external to the cavity.

12. The method of claim 11, wherein a majority of the emitted light is directed the second time towards the first sidewall or the second sidewall.

13. The method of claim 12, wherein the lens has a transmissivity of approximately 85.

14. The method of claim 11, wherein the emitted light is directed a first time via a reflective coating disposed on at least one of the first surface or the second surface.

15. The method of claim 14, wherein the reflective coating has a reflectance value of approximately 95%.

16. The method of claim 11, wherein the step of emitting light comprises emitting light from a light source comprising a plurality of light emitting diodes (LEDs) arranged in a linear array on the base.

17. The method of claim 16, wherein directing, via the first sidewall or the second sidewall, the emitted light from the light source a first time towards the lens comprises directing the emitted light toward first and second sidewalls disposed at an obtuse angle relative to the base such that a cross-section taken through the base and the first and second sidewalls has a trapezoidal shape.

18. The method of claim 11, wherein the light is emitted from the light source in a batwing light distribution.

19. The method of claim 11, wherein at least one of the first sidewall or the second sidewall forms at least one of a linear, a parabolic, an involute, or a hyperbolic cross-sectional shape.

20. The method of claim 11, further comprising the step of directing the emitted light at least a third time.

* * * * *